US006928936B1

(12) United States Patent
Mukherjee et al.

(10) Patent No.: US 6,928,936 B1
(45) Date of Patent: Aug. 16, 2005

(54) DEVICE FOR FEEDING PULVERIZED COAL TO FURNACE

(75) Inventors: Ashis Mukherjee, Jharkhand (IN); Subhasis Biswas, Jharkhand (IN); Manish Kumar, Jharkhand (IN); Santi Gopal Sahu, Jharkhand (IN); Nandita Choudhury, Jharkhand (IN); Ashim Choudhury, Jharkhand (IN); Kalyan Sen, Jharkhand (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 10/806,066

(22) Filed: Mar. 22, 2004

(51) Int. Cl.[7] ..... F23H 3/00
(52) U.S. Cl. ..... 110/293; 110/101 R; 110/108; 110/267; 110/186
(58) Field of Search ..... 110/293, 294, 101 R, 110/105, 108, 109, 110, 114, 118, 267, 185, 110/186

(56) References Cited

U.S. PATENT DOCUMENTS 718,985 A * 1/1903 Davis ..... 406/52
4,092,094 A 5/1978 Lingl, Jr.
4,744,311 A 5/1988 Piekos
5,485,812 A * 1/1996 Firey ..... 123/23
5,997,234 A * 12/1999 Norris ..... 414/196

FOREIGN PATENT DOCUMENTS

GB 281098 11/1927
GB 335163 9/1930

* cited by examiner

*Primary Examiner*—Kenneth Rinehart
(74) *Attorney, Agent, or Firm*—Ladas & Parry

(57) ABSTRACT

The present invention provides a device for feeding pulverized coal to a furnace, such as a drop tube furnace. The feeding system consists of a feed hopper, a pneumatic vibrator positioned on the periphery of the feeder hopper, a needle valve arrangement in the said feed hopper, a depth gauge micrometer, a distribution chamber with primary and secondary airline at the bottom of the said feed hopper. Adjusting the pressure of compressed air allows setting of the frequency of vibration of the pneumatic vibrator. The needle valve arrangement in conjunction with the vibratory hopper controls the feed rate. The rate of coal flow is measured by the depth gauge micrometer. The distribution chamber with primary and secondary airline at the bottom of the said feed hopper allows uniform mixing of air with coal before being charged into the furnace reactor.

9 Claims, 2 Drawing Sheets

DEVICE FOR FEEDING PULVERIZED COAL TO FURNACE

FIELD OF THE INVENTION

Figure 1:
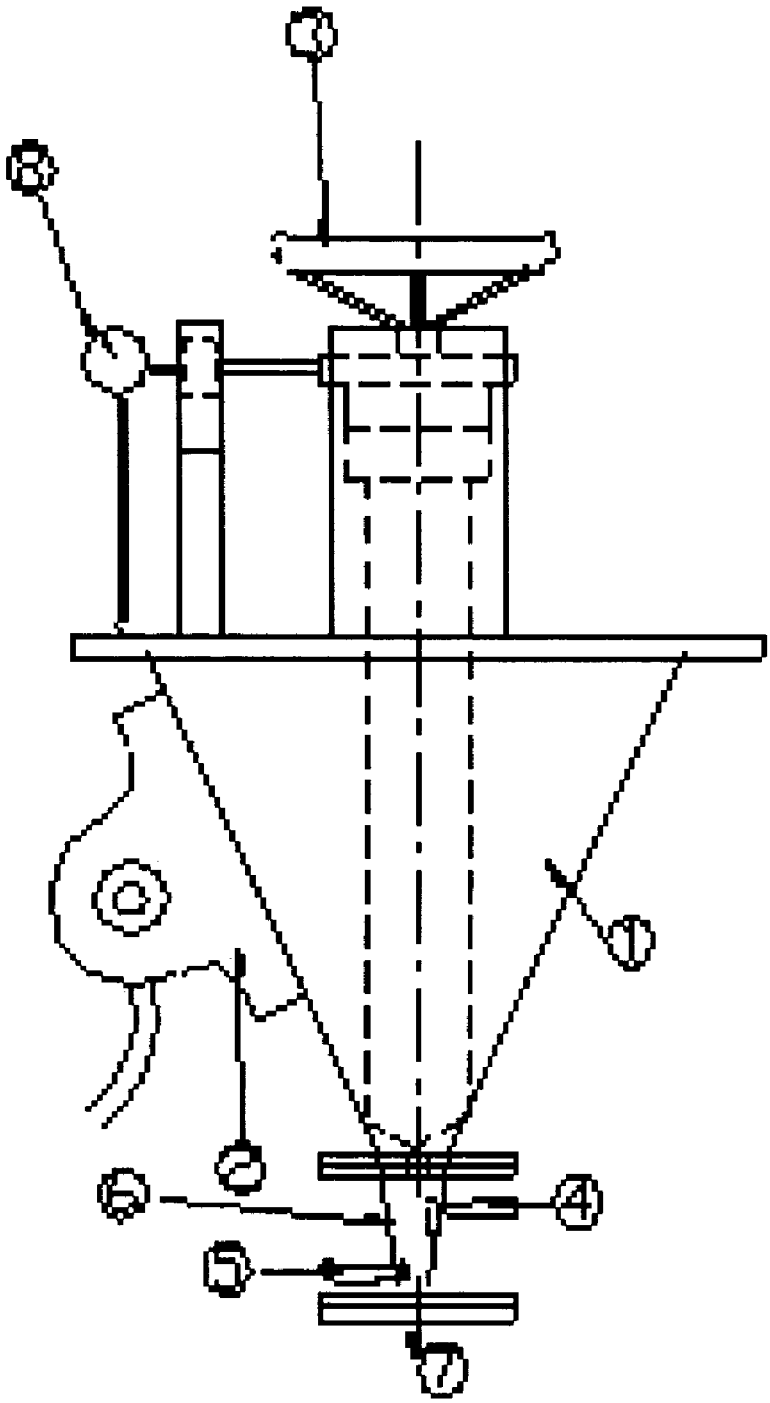

This invention relates to a device for feeding pulverized coal to a furnace. This invention specifically relates to a system of feeding pulverised coal to a furnace, such as a drop tube furnace.

The present invention finds usage in studying chemical reactivity and combustion behaviour of various coals in an experimental furnace such as a drop tube furnace.

BACKGROUND OF THE INVENTION

Experimental furnaces are generally used to simulate combustion and deposition conditions in pulverised fuel boilers. The essential characteristics of such reactors are heating rate, high temperature, dynamic particle phase and atmosphere simulating conditions. For example, the essential components of an experimental furnace such as a vertical drop tube furnace system include a fuel feeder, a reactor and equipment for sampling and analysis. The drop tube furnace is a valuable tool when attempting to simulate coal combustion on a small scale. In this furnace pulverised coal is carried down through a water cooled feeder into a heated ceramic tube containing pre-heated air. After passing through the tube the particles are collected in a water cooled probe in different zones where the reactions are effectively quenched. The flow of these gases is kept sufficiently low to ensure that laminar flow conditions are met. Turbulent flow would cause the reduction of collection efficiency and the lowering of the sample integrity. The degree of decomposition experienced by the particles depends on conditions within the furnace. The residence time inside the furnace, oxygen content and the temperature can be altered as per the requirements.

Reference is made to U.S. Pat. No. 5,997,234, wherein a silicon pellet feed system has been described for use with a silicon melt furnace used to grow a silicon web. A reservoir for containing feed particles is coupled to the upper end of a feed tube. The lower end of the feed tube is positioned adjacent to a pair of rotatable drive rollers driven by a motor through a coupling and a pair of gears. The rollers are mounted at an angle with respect to horizontal and the outlet end of the roller feed path is located above a delivery tube leading to the silicon melt furnace. The elements are surrounded by an enclosure having a vacuum outlet for enabling the enclosure to be evacuated to a working vacuum level and a gas inlet for enabling an inert gas to be back filled into the enclosure. The feed rate is determined by the angle of the drive rollers, the speed of the motor and the shape of the bottom end of the feed tube. The rollers are resilient to provide enhanced surface friction for the particle flow and to prevent trapped feed particles from jamming the motor. The said system is not suitable for the purposes of an experimental furnace such as a vertical drop tube furnace system, which requires feeding pulverised coal to the furnace.

Prior art search for a feeding system for feeding pulverised coal to a furnace was made based on literature survey and patent databases, which did not yield any relevant references.

Therefore, there is a definite need to provide a feeding system for a furnace, specifically a system of feeding pulverised coal to a furnace, such as a drop tube furnace.

OBJECTS OF THE INVENTION

The main object of the present invention is to provide a device for feeding pulverized coal to a furnace, such as a drop tube furnace.

Another object of the present invention is to provide a feeding system ensuring a steady flow rate.

Yet another object of the present invention is to provide a feeding system capable of accurate feed consistently.

Still another object of the present invention is to provide a feeding system which is easy to operate and is maintenance free.

SUMMARY OF THE INVENTION

The present invention provides a device for feeding pulverized coal to a furnace, such as a drop tube furnace. The feeding system consists of a feed hopper, a pneumatic vibrator positioned on the periphery of the feeder hopper, a needle valve arrangement in the said feed hopper, a depth gauge micrometer, a distribution chamber with primary and secondary airline at the bottom of the said feed hopper. Adjusting the pressure of compressed air allows setting of the frequency of vibration of the pneumatic vibrator. The needle valve arrangement in conjunction with the vibratory hopper controls the feed rate. The rate of coal flow is measured by the depth gauge micrometer. The distribution chamber with primary and secondary airline at the bottom of the said feed hopper allows uniform mixing of air with coal before being charged into the furnace reactor.

Accordingly the present invention provides a device for feeding pulverized coal to a furnace, which comprises in combination a feed hopper (1) incorporating a needle valve arrangement (3) and a depth gauge micrometer (8) capable of controlling and measuring the feed rate; the feed hopper (1) being provided on the external periphery with a pneumatic vibrator (2); the feed hopper (1) being also provided at the bottom end with a distribution chamber (6) having primary (4) and secondary (5) compressed air-lines, the distribution chamber (6) being provided with means for connecting to a furnace reactor (7).

In an embodiment of the invention the feeder hopper (1) is preferably made of non-reactive material, such as stainless steel.

In another embodiment of the invention the needle valve arrangement (3) consists of feed rate control means (3.1, 3.2 and 3.4) to control the feed rate through vertical movement of needle (3.3).

In a further embodiment of the invention, at least one feed rate control means comprises a movable roller (3.2).

In yet another embodiment of the invention the depth gauge micrometer (8) capable of measuring the feed rate is connected through the movable roller (3.2) to the needle valve arrangement (3).

In still another embodiment of the invention the pneumatic vibrator is provided with compressed air adjustment means to adjust pressure of compressed air.

In still another embodiment of the invention the distribution chamber (6) connects the feed hopper bottom and furnace reactor (7).

In a further embodiment of the invention the distribution chamber (6) is connected to the feed hopper bottom and furnace reactor (7) by means such as flange-joint.

Figure 2:
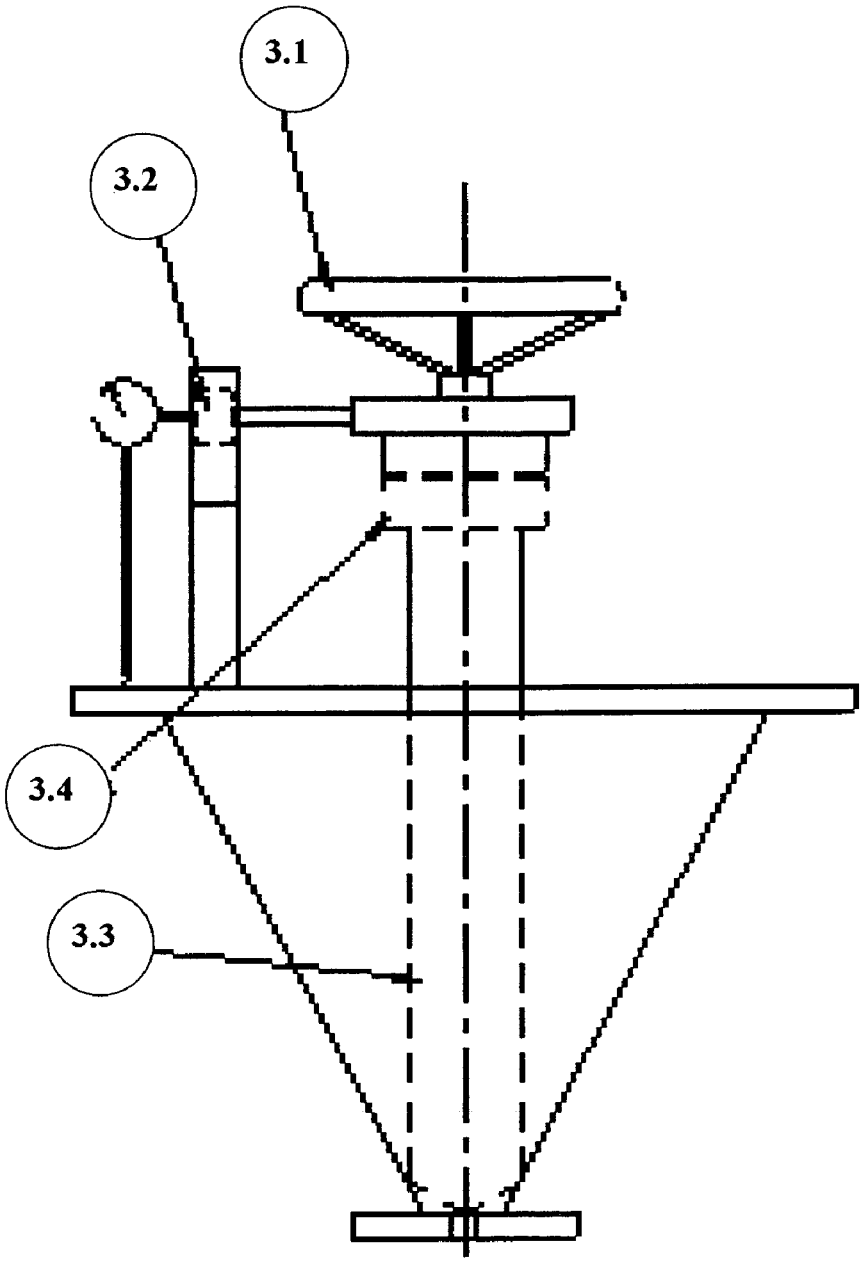

In the drawings accompanying this specification, the various components which in combination constitute the device of the present invention are shown in FIGS. 1 and 2.

BRIEF DESCRIPTION OF THE ACCOMPANYING DRAWINGS

FIG. 1 depicts and describes an embodiment of the general arrangement of the device of the present invention for feeding pulverized coal to a furnace, such as a drop tube furnace. The various parts as shown in FIG. 1 are:

1 Feeder hopper.

2 Pneumatic vibrator positioned on the periphery of the feeder hopper.

3 Needle valve fitted in the feed hopper controls the feed rate.

4 Primary compressed air-line is provided in the distribution chamber at the bottom of the said feed hopper.

5 Secondary compressed air-line is provided in the distribution chamber at the bottom of the said feed hopper.

6 Distribution chamber with primary and secondary airline at the bottom of the said feed hopper allows uniform mixing of air with coal before being charged into the furnace reactor.

7 Furnace reactor.

8 Depth gauge micrometer measures the rate of flow of coal to the reactor.

FIG. 2 of the drawings depicts and describes the needle valve arrangement. The various parts as shown in FIG. 2 are:

3.1 Needle valve.

3.2 Movable roller.

3.3 Needle.

3.4 Lock nut.

DETAILED DESCRIPTION OF THE INVENTION

Accordingly the present invention provides a device for feeding pulverized coal to a furnace, which comprises in combination a feed hopper (1) incorporating a needle valve arrangement (3) and a depth gauge micrometer (8) capable of controlling and measuring the feed rate; the feed hopper (1) being provided on the external periphery with a pneumatic vibrator (2); the said feed hopper (1) being also provided at the bottom end with a distribution chamber (6) having primary (4) and secondary (5) compressed air-lines, the said distribution chamber (6) being provided with means for connecting to a furnace reactor (7).

In an embodiment of the present invention the feeder hopper (1) is preferably made of non-reactive material, such as stainless steel.

In another embodiment of the present invention the needle valve arrangement (3) consists of means (3.1, 3.2 & 3.4) capable of controlling the feed rate through vertical movement of needle (3.3).

In yet another embodiment of the present invention the depth gauge micrometer (8) capable of measuring the feed rate is connected through the movable roller (3.2) to the needle valve arrangement (3).

In still another embodiment of the present invention the pneumatic vibrator is provided with adjustable pressure of compressed air.

In still yet another embodiment of the present invention the distribution chamber (6) connects the feed hopper bottom and furnace reactor (7).

In a further embodiment of the present invention the distribution chamber (6) is connected to the feed hopper bottom and furnace reactor (7) by means such as flange-joint.

The novelty of the device of the present invention for feeding pulverized coal to a furnace resides in providing a feeding system capable of enabling a controlled and measured steady flow rate of pulverized coal to a furnace reactor.

The novelty has been achieved by the non-obvious inventive steps of providing in combination a feed hopper incorporating a needle valve arrangement, a pneumatic vibrator with adjustable pressure of compressed air, a depth gauge micrometer and a distribution chamber having primary and secondary compressed air-lines, capable of controlling and measuring a consistent feed rate of pulverized coal to a furnace reactor.

The device of the present invention for feeding pulverized coal to a furnace works as follows:

Pulverised coal is stored in the feed hopper (1). Pulverised coal is pushed from hopper to the distribution chamber (6) with the help of the pneumatic vibrator (2) and compressed primary air (4). Primary air is around 15–30% of the total air. By changing the frequency of vibration and by adjusting the position of needle valve (3) the coal flow rate is adjusted. The frequency of vibration in the pneumatic vibrator (2) is set by changing the pressure of compressed air. The rate of coal flow is measured by the depth gauge micrometer (8). After hopper coal with primary air enters the distribution chamber (6), the coal is mixed with secondary air uniformly. From the distribution chamber (6) the pulverised coal and air mixture enters the reactor (7).

The following examples are given by way of illustration of the device of the present invention for feeding pulverized coal to a furnace in actual practice and should not be construed to limit the scope of the present invention.

Example 1

Pulverised coal was stored in the feed hopper of capacity 5 kg. Pulverised coal was pushed from the hopper to the distribution chamber with the help of the pneumatic vibrator. The pressure of air for pneumatic vibrator was 1.5 kg/cm$^2$. Compressed primary air rate was 60 liters per minute and pressure was 1.6 kg/cm$^2$. The secondary air rate was 130 liters per minute. From the distribution chamber the pulverised coal and air mixture enterered the furnace reactor. The rate of coal flow as measured by the depth gauge micrometer was 1.5 kg/hr.

Example 2

Pulverised coal was stored in the feed hopper of capacity 5 kg. Pulverised coal was pushed from the hopper to the distribution chamber with the help of the pneumatic vibrator. The pressure of air for pneumatic vibrator was 1.8 kg/cm$^2$. Compressed primary air rate was 65 liters per minute and pressure was 1.7 kg/cm$^2$. The secondary air rate was 140 liters per minute. From the distribution chamber the pulverised coal and air mixture enterered the furnace reactor. The rate of coal flow as measured by the depth gauge micrometer was 2.0 kg/hr.

Example 3

Pulverised coal was stored in the feed hopper of capacity 5 kg. Pulverised coal was pushed from the hopper to the distribution chamber with the help of the pneumatic vibrator. The pressure of air for pneumatic vibrator was 1.3 kg/cm$^2$. Compressed primary air rate was 50 liters per minute and pressure was 1.3 kg/cm$^2$. The secondary air rate was 123 liters per minute. From the distribution chamber the pulverised coal and air mixture enterered the furnace reactor. The rate of coal flow as measured by the depth gauge micrometer was 1.2 kg/hr.

The main advantages of the device of the present invention for feeding pulverized coal to a furnace are:

1. The feeding system provides consistent and accurate feed.
2. The feeding system is easy to operate.
3. The feeding system is easy to maintain.

We claim:

1. A device for feeding pulverized coal to a furnace, which comprises in combination a feed hopper (1) incorporating a needle valve arrangement (3) and a depth gauge micrometer (8) capable of controlling and measuring the feed rate; the feed hopper (1) being provided on the external periphery with a pneumatic vibrator (2); the feed hopper (1) being also provided at the bottom end with a distribution chamber (6) having primary (4) and secondary (5) compressed air-lines, the distribution chamber (6) being provided with means for connecting to a furnace reactor (7).

2. A device as claimed in claim 1 wherein the feeder hopper (1) is made of a non-reactive material.

3. A device as claimed in claim 1 wherein the feeder hopper (1) is made of stainless steel.

4. A device as claimed in claim 1 wherein the needle valve arrangement (3) consists of feed rate control means (3.1, 3.2 and 3.4) to control the feed rate through vertical movement of needle (3.3).

5. A device as claimed in claim 3 wherein at least one feed rate control means comprises a movable roller (3.2).

6. A device as claimed in claim 1 wherein the depth gauge micrometer (8) capable of measuring the feed rate is connected through the movable roller (3.2) to the needle valve arrangement (3).

7. A device as claimed in claim 1 wherein the pneumatic vibrator is provided with compressed air adjustment means to adjust pressure of compressed air.

8. A device as claimed in claim 1 wherein the distribution chamber (6) connects the feed hopper bottom and furnace reactor (7).

9. A device as claimed in claim 1 wherein the distribution chamber (6) is connected to the feed hopper bottom and furnace reactor (7) by a flange-joint.

* * * * *